US005833148A

United States Patent [19]

Steinhilber et al.

[11] Patent Number: 5,833,148

[45] Date of Patent: Nov. 10, 1998

[54] HIGH-PRESSURE JET NOZZLE

[75] Inventors: Ernst Steinhilber, Moglingen; Thomas Haegler, Weinstadt; Erwin Steiner, Schorndorf, all of Germany

[73] Assignee: Spraying Systems Deutschland GmbH & Co. KG, Germany

[21] Appl. No.: 734,653

[22] Filed: Oct. 21, 1996

[30] Foreign Application Priority Data

Nov. 4, 1995 [DE] Germany ..... 195 41 174.9

[51] Int. Cl.[6] ..... B05B 1/00

[52] U.S. Cl. ..... 239/601; 239/DIG. 19

[58] Field of Search ..... 239/589, 601, 239/602, DIG. 19

[56] References Cited

U.S. PATENT DOCUMENTS

| | | | |
|---|---|---|---|
| 2,305,210 | 12/1942 | Wahlin | 239/601 |
| 2,641,509 | 6/1953 | Yost . | |
| 2,701,412 | 2/1955 | Wahlin | 239/601 |
| 2,774,631 | 12/1956 | Wahlin . | |
| 3,104,829 | 9/1963 | Wahlin | 239/601 |
| 3,510,065 | 5/1970 | Gigantino et al. | 239/601 |

FOREIGN PATENT DOCUMENTS

| | | | |
|---|---|---|---|
| 470743 | 1/1951 | Canada | 239/601 |
| 27 24 173 | 11/1978 | Germany . | |
| 29 27 737 | 8/1981 | Germany . | |
| 40 17 594 | 12/1991 | Germany . | |
| 94/17921 | 8/1994 | WIPO | 239/601 |

*Primary Examiner*—Lesley D. Morris
*Attorney, Agent, or Firm*—Leydig, Voit & Mayer, Ltd.

[57] ABSTRACT

A flat-jet nozzle 1 for high-pressure cleaning apparatus has a nozzle mouth passaage formed by the intersection of a depression 21 with half-round base 22 shaped into a nozzle body 2 and a channel 6 leading to the nozzle mouth. In the zone of intersection with the depression 21, the channel has a spherically vaulted wall 12. The width b of the resulting passage α and the angle between the wall 12 bounding the edge 26 and the longitudinal axis 17 of the channel are dimensioned in such manner that a point defined by this value pair lies inside of a zone bounded by a hyperbolas. This tolerance range is given by the equation:

$$(b-B)\cdot(\alpha-\alpha_o)=C,$$

in which: the width b is measured in millimeters (mm) and the angle α is measured in degrees (°), the constant B lies in the range between 0.785 mm and 0.875 mm, the constant $\alpha_O$ lies between 8.25° and 17.25°, and the constant C lies in a range from 12° mm to 13° mm.

18 Claims, 4 Drawing Sheets

HIGH-PRESSURE JET NOZZLE

FIELD OF THE INVENTION

The invention relates generally to spray nozzles, and more particularly, to jet nozzles for high-pressure cleaning apparatus.

BACKGROUND OF THE INVENTION

Such spray nozzles are used, for example, for generating a fan-shaped jet in high-pressure cleaning apparatus. The spray nozzle serves the function of allowing water to be aimed with high pressure of 20 to 250 bar so that there results a flat jet with a strip-form or virtually linear spray pattern. In cleaning apparatus with such high pressure jet, good cleaning is achieved since the highly accelerated water droplets proceeding from the nozzle bring about a mechanical removal effect on the impingement surface to be cleaned. The aim in the development of such cleaning apparatus is to achieve with as little as possible consumption of water a high cleaning effect, i.e. a good removal effect. A measure for this is the generated jet force, which is defined as the force which is exerted on a given surface area by the impinging jet.

EP 0 655 281 A1 discloses a flat-jet nozzle with a circular nozzle mouth. The nozzle has an admittance chamber in a nozzle body, which chamber is formed essentially cylindrically and is closed with a front wall containing the nozzle mouth. The front wall is hemispherically formed on its inside, which bounds the admittance chamber and defines a spherically rounded wall surface. The nozzle mouth proper is formed by a circular cylindrical bore which leads coaxially to the admittance chamber through the front wall. In the transition between the cylindrical bore and the spherically rounded wall of the admittance chamber there is formed an ovally bounded depression which defines two oppositely lying pockets on both sides of the cylindrical bore. A plane surface surrounds the outside the cylindrical bore forming the nozzle mouth. This nozzle geometry brings about a fanning-out of the jet emerging from the nozzle mouth so that a flat jet is formed.

DE 4 213 226 A1 discloses a flat-jet nozzle which likewise has a circular nozzle opening or mouth. The flat-jet nozzle includes a body which encloses an interior space leading to the nozzle mouth. In the region of the nozzle mouth, the interior is spherically vaulted and has in the transition of the nozzle mouth two depressions or pockets lying diametrically opposite one another. These serve for the flow guidance in order to fan out the jet emerging from the nozzle mouth and thus to generate a flat jet. The form and symmetry of the depressions, as well as their trueness to measure, are critical for the jet form and jet strength.

DE 4 341 870 A1, in contrast, discloses an ultra-high-pressure flat jet nozzle which has a nozzle body with a conical feed channel. To form a nozzle mouth, a wedge-shaped slot in the outside of the nozzle body crosses the conical feed channel. The resulting emergence opening is defined by the section between the conical feed channel and the wedge-shaped slot. The form of the emergence opening brings about a fanning-out of the emerging jet and therewith the generation of a flat jet.

Further there are known in actual practice flat-jet nozzles that have an oval nozzle mouth. A channel leading through a nozzle body ends at a front wall containing the nozzle mouth in a spherical dome. In the nozzle front wall there is provided a transverse groove which cuts into the channel in the zone of the spherically arched wall.

OBJECTS AND SUMMARY OF THE INVENTION

It is an object of the invention to provide a spray nozzle for generating a flat jet adapted for more effective cleaning of surfaces by the mechanical action of such jet.

This object is carried out by a spray nozzle having a body which has a longitudinal channel that ends in a downstream nozzle mouth, the channel having a channel wall which narrows toward the nozzle mouth and defines therewith an edge of a liquid passage. According to the invention, a width "b" of the passage and an angle $\alpha$ between the channel wall at the edge of the passage and the longitudinal axis of the channel come within a defined range. Nozzles having parameters within that range have been found to produce increased jet force and increased jet pressure, as compared to conventional nozzles, when operated under similar conditions, such as water pressure, distance of the nozzle mouth from the surface to be treated, water consumption, and spray angle. The jet pressure is determined by the force exerted by the jet on an impingement area of a test surface.

The defined range can be illustrated in a graph or diagram, the ordinate of which marks widths "b" of the passage and the abscissa of which marks different wall angles. The range corresponds generally to a hyperbolic curve. Jet nozzles whose passage width "b" and whose wall angle form a value pair lying within the range yield at a given water pressure a high jet force without increased water consumption. For value pairs of passage width and wall angle that lie outside the range, the jet force decreases with increasing departure from the range. The optimal range can be narrowed with the use of specific constants in the determined relationship of the passage width "b" and wall angle $\alpha$. However, it is to be sought that in any case the width "b" of the passage lies in a range from 0.95 to 2.45 mm. Correspondingly the angle $\alpha$ between the channel wall following upon the edge and the channel axis in the outflow or downstream direction lies between 15° and 80°. The outflow or downstream direction is defined as the direction along a nozzle axis concentric to the channel. The fan-shaped jet emerging from the spray nozzle spreads in the outflow or downstream direction. This means that nozzle axis in the outflow or downstream direction lies symmetrically in the fan-shaped flat jet. A simple and reliable production of a symmetric flat jet is achieved if the channel is constructed rotationally or cylindrically symmetrical to the passage. However, if need be, differing forms are possible.

The edge marking the transition between the feeding channel and the nozzle mouth is preferably curved throughout and, therefore, presents no straight section. This is advantageous for a uniform development of a flat jet. The nozzle mouth deviates from the circular form and approaches the form of an ellipse.

The passage is preferably defined by a groove running transversely to the outflow direction, which groove cuts the narrowing channel on the face side. The resulting passage resembles an ellipse in form and has different wall angles along its circumference, i.e. angles between the channel wall on the edge and the outflow direction. However, the measurement relation according to the invention holds true especially in measuring transversely to the groove.

The groove cutting the channel preferably has a curved base, so that the nozzle mouth can be conceived, for example, as a section between a sphere and a cylinder wall. This is the case, for example, when the wall of the channel about the passage is spherically rounded. The wall can be vaulted with respect to a single center of curvature and can also be constructed deviating therefrom.

Such nozzle forms render unnecessary the need for recesses, pockets or the like arranged in the channel. Accordingly, the wall following upon the passage can be formed smooth. This increases the manufacturing reliability and simplifies the production considerably.

The formation of a flat jet is promoted if on both sides of the nozzle mouth there are formed ribs which have oppositely lying wall sections constructed at least section-wise flat. The flow relations yielded thereby before the nozzle mouth lead then to a favorable jet image.

The channel leading through the nozzle body can narrow from a large connection diameter to a comparatively small diameter of a substantially cylindrical section following the passage. This occurs preferably without ledges, i.e. with truncated conical transition sections. These prevent an impairment of the jet image as well as dynamic pressure losses.

The parameters indicated are provided especially for spray nozzles with an opening angle from 15° to 35°. In this range the increase of the jet force is especially promoted. A one-piece construction of the nozzle body prevents misadjustments in installation and disassembly and ensures the desired results.

Other objects and advantages of the invention will become apparent upon reading the following detailed description and upon reference to the drawings in which:

Figure 1:
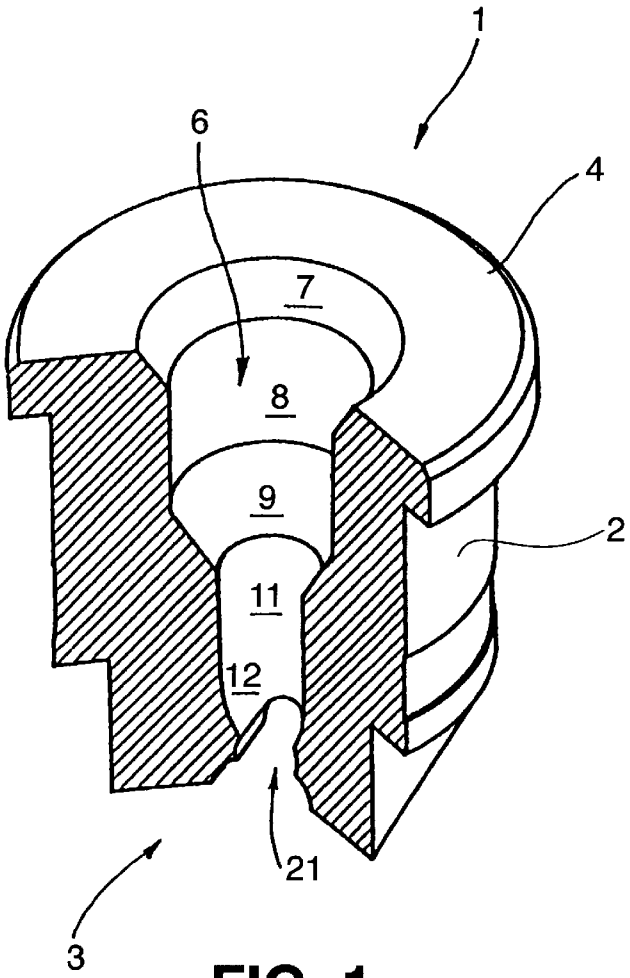
FIG. 1 is a perspective of a spray nozzle in accordance with the present invention, partially shown in section.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Referring now more particularly to the drawings, there is shown an illustrative spray nozzle 1 embodying the present invention which is adapted for use in high-pressure cleaning apparatus for ejecting a high-pressure fan-shaped water jet against surfaces to be cleaned. The spray nozzle 1 has a nozzle body 2 preferably constructed in one piece of a metal or ceramic material. Alternatively, it will be understood that the nozzle body 2 can be made from a multiplicity of parts. The nozzle body includes an upstream flange 4, which may be connected to a spray head by suitable fastening means, such as a cap nut. The nozzle body has a downstream nozzle mouth zone 3. In the illustrated embodiment, the nozzle is substantially symmetrical in form, rotatably or cylindrically, with respect to a longitudinal axis 17, up to the nozzle mouth zone 3.

Figure 4:
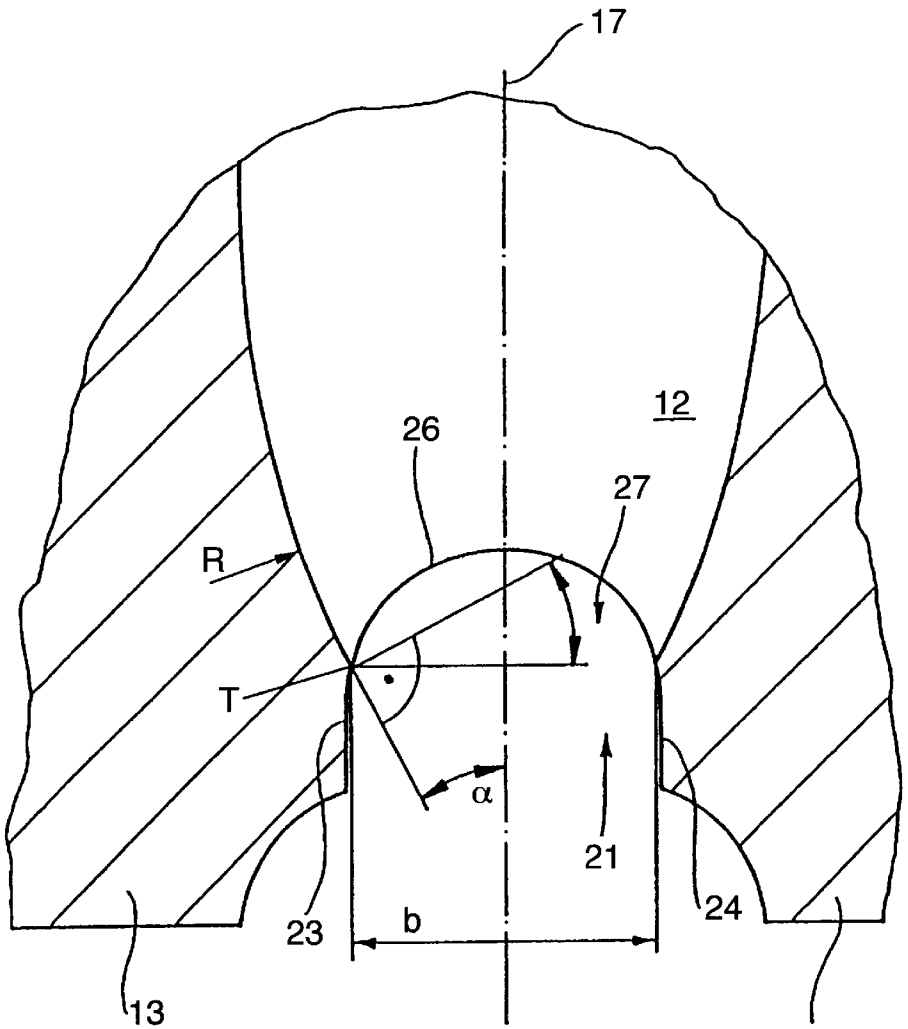
FIG. 4 is an enlarged fragmentary section of the mouth of the illustrated spray nozzle.

Through the nozzle body 2 there leads a channel 6 which is constructed as a bore concentric to the nozzle body 2, the diameter of which decreases toward the nozzle mouth zone 3. On a conical entry zone 7 lying immediately at the flange 4 there follows a cylindrical channel section 8, which communicates through a conical transition zone 9 with a cylindrical channel section 11 of smaller diameter than the upstream or first cylindrical channel section 8. As is evident especially from FIG. 2 and FIG. 4 illustrating the enlarged nozzle mouth zone 3, the channel section 11 narrows toward the nozzle mouth zone 3 and in so doing presents a rounded wall 12.

Figure 3:
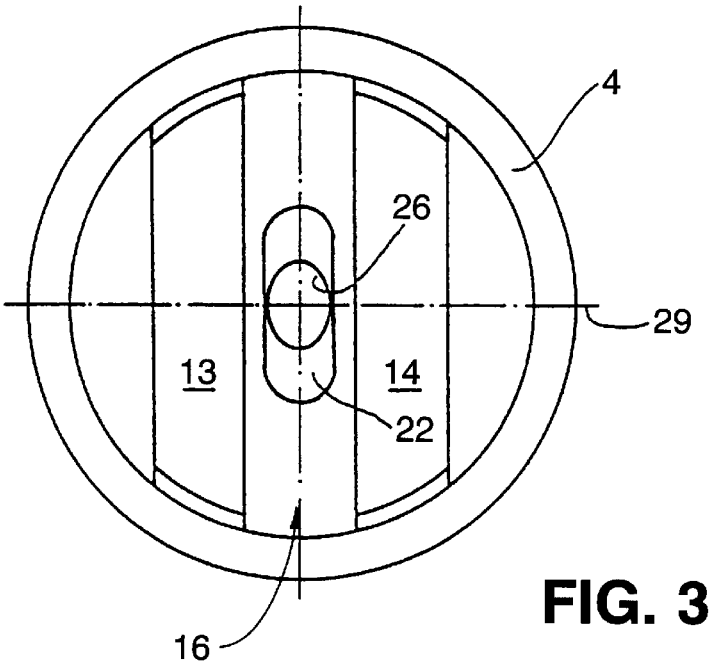
FIG. 3 is a plan view at the mouth end of the illustrated spray nozzle.
Figure 2:
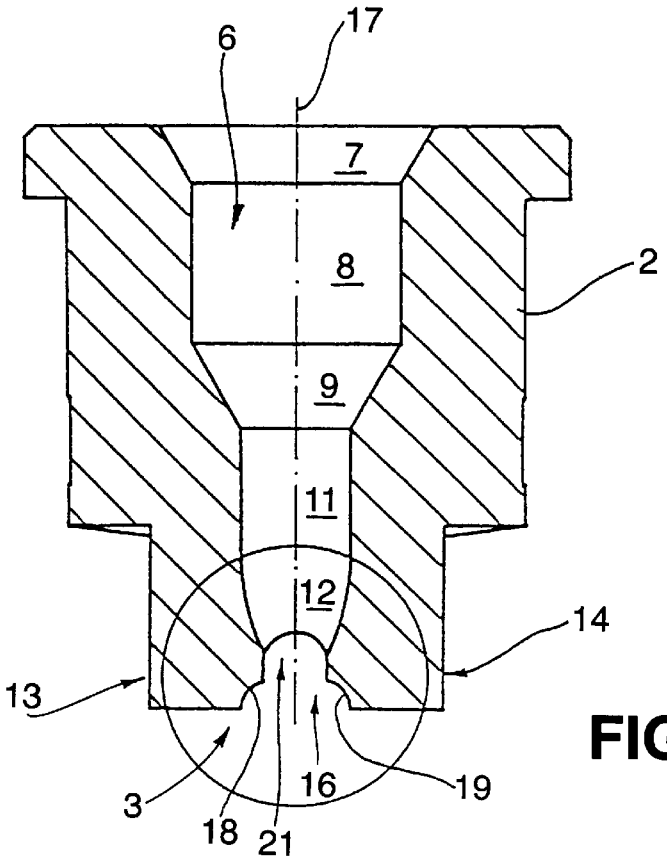
FIG. 2 is a longitudinal section of the spray nozzle shown in FIG. 1.

The nozzle mouth zone 3, as is evident from FIGS. 2 and 3, is formed by two ribs or flat ends 13, 14 located in spaced parallel relation to one another and formed in the one piece nozzle body 2, which ribs are separated by a groove 16. The groove 16 runs between the ribs 13, 14 transversely through the nozzle body 2 and is therefore arranged at a right angle to a longitudinal central axis 17 of the channel 6. The groove 16 has rounded side walls 18, 19 which in each case follow a circular arc. Centrally in the groove 16 there is provided an outwardly opening groove-type depression 21 which has a base 22 rounded at its ends and defining plane-constructed groove walls 23, 24, which are arranged lying opposite one another in spaced parallel relation.

The depression 21 intersects the channel section 11 of the channel 6 in the zone of the spherically rounded wall 12, there being formed a passage 27 bounded by an edge 26. The edge 26 there, as shown in from FIG. 3, is continuously curved and in plan view resembles an ellipse. It is defined by the section of a semicylindrical base 22 of the depression 21 with the spherically curved wall 12 of the channel section 11. The radius of curvature R of the wall 12 can exceed there the diameter of the channel 11. The center points of curvature lie, for example, on a circle lying concentrically to the channel. The radius of curvature of the ends of the base 22 of the depression 21, in contrast, is clearly smaller and corresponds to half the distance separating the groove walls 23, 24 from one another. The depression 21 there extends so deeply that the edge 26 in the zone of the transverse or small half-axis of the passage 27 (i.e. the direction of which is marked in FIG. 3 with a dot-and-dashed line 29) very nearly reaches the plane groove walls 23, 24. The width b of the passage 27 measured along the axis line 29 preferably is between 0.9 and 2.5 mm depending on the desired throughput, and is only slightly less than the distance that separates the groove walls 23, 24.

If in the zone of the line 29 a tangent T is applied to the edge zone of the wall 12, this tangent forms an angle a with the longitudinal central axis 17 which lies, according to the chosen width b in the range from 15° to 80°. Depending on the width b in mm the angle $\alpha_A$ optimally is established by the following relation:

$$\alpha_A = \frac{35.5}{(b - 0.83) \cdot 2.793} + 12.75[°] \tag{1}$$

in which $\alpha_A$ represents the wall angle at which the maximal jet force is achieved. At a distance from the line 29 the wall angle deviates from the value $\alpha_A$. Conversely there holds for the optimal width $b_A$ the following:

$$b_A = \frac{35.5}{(\alpha_A - 12.75) \cdot 2.793} + 0.83\,[\text{mm}]. \quad (2)$$

Figure 5:
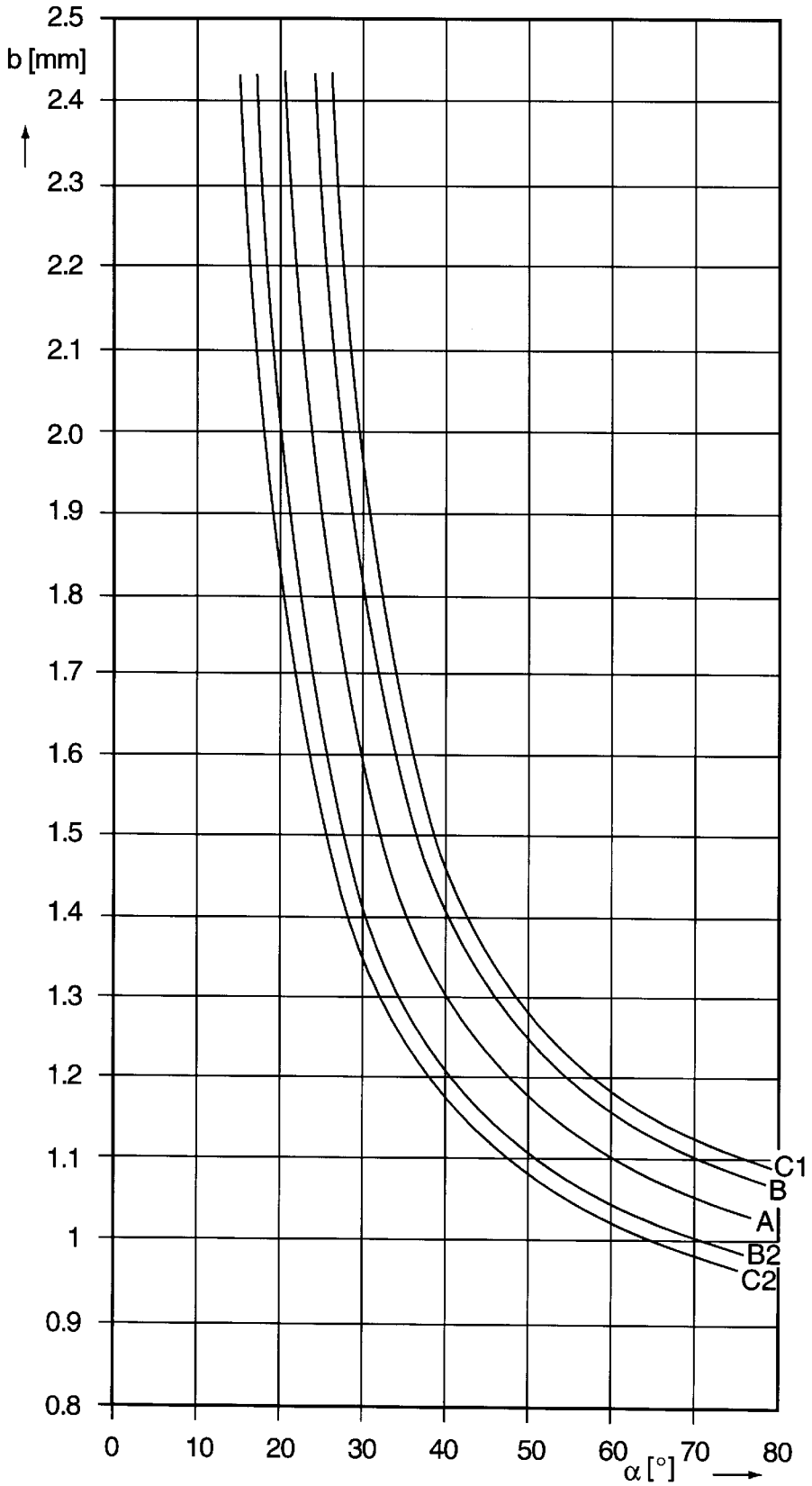
FIG. 5 is a graph depicting preferred ranges of measurements of parameters of the illustrated spray nozzle for achieving increased jet force.

The curve for value pairs for the width b and the wall angle satisfying the above equation is represented in FIG. 5 and designated with A. It is a matter here of a hyperbola in the vicinity of which comparatively good results are achieved for the jet force. The region is bounded by the curves C1 and C2, which are likewise hyperbolas and are determined in conjunction with equation 1 by the following formulas:

$$b_{c1}=(b_A+0.045)mm$$

$$\alpha_{c1}=(\alpha_A+4.5)^\circ$$

for the curve C1, as well as the formulas $$b_{c2}=(b_A-0.045)mm$$

$$\alpha_{c2}=(\alpha_A-4.5)^\circ$$

for the curve C2.

Figure 6:
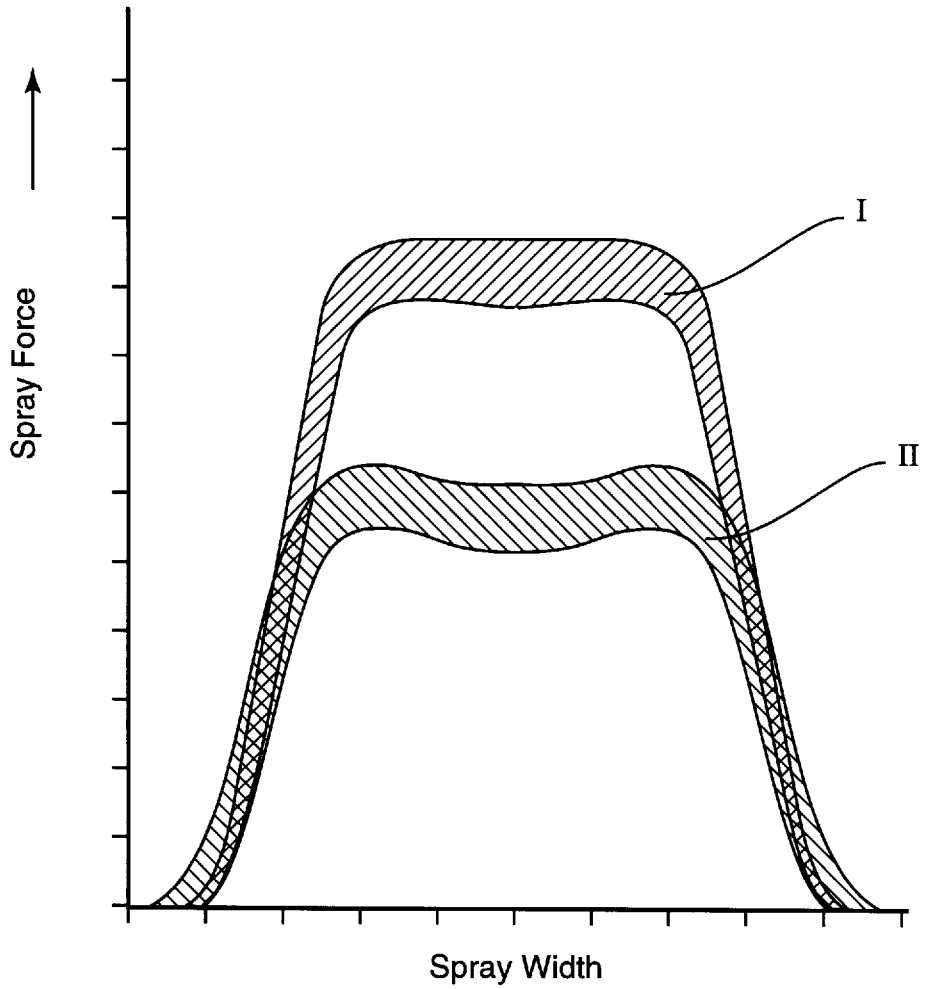
FIG. 6 is an illustrative comparison of the jet force of nozzles, the dimensions of which lie within the value ranges set forth in FIG. 5, and the jet force of nozzles with dimensions of which lie outside that range.

With value pairs that lie within the range defined by the curves C1 and C2, there are obtained flat-jet nozzles 1 the jet force of which is illustrated in FIG. 6 by a tolerance range I. Underlying the diagram are exemplary nozzles with a spray angle of 25°. The jet force—in all examples with water consumption and water pressure remaining the same—is increased by a third with respect to conventional flat-jet nozzles that lie in tolerance range II and whose dimensions lie outside the range characterized in FIG. 5 with the curves C1, C2. Tests have yielded that with use of flat-jet nozzles as jet nozzles for high-pressure cleaning, the cleaning effect is substantially improved by more than a third.

The range limits B1, B2 within which especially good results are achieved are defined in conjunction with equation 1 as follows:

$$b_{B1}=(b_A=0.032)mm$$

$$\alpha_{B1}=(\alpha_A+3.2)^\circ$$

$$b_{B2}=(b_A-0.032)mm$$

$$\alpha_{B2}=(\alpha_A-3.2)^\circ$$

As is likewise evident from FIG. 6, moreover, the jet force is largely constant over the entire jet width, so that in cleaning operations with the flat-jet nozzle 1 a uniform result can be achieved. However, if need be, by fixing of the other measurements there can also be obtained a middle- or border-emphasized jet.

A flat jet nozzle 1 for high-pressure cleaning apparatus has a nozzle mouth which is formed by the intersection of a depression 21 shaped from outside into a nozzle body 2, with half-round base 22 and a channel 6 leading to the nozzle mouth. The channel 6 is formed in the nozzle body 2 and in the zone of the intersection with the depression 21 it has a spherically domed wall 12. At the resulting edge which defines a passage from the channel 6 to the depression 21, the width of the passage and the angle of the wall 12 bounding on the edge 26 are dimensioned with respect to the longitudinal central axis 17 in such a manner that a point defined by this value pair lies within a range bounded by hyperbolas. This tolerance range is given by the equation:

$$(b_A-B)\cdot(\alpha_A-\alpha_o)=C$$

in which: the width b is measured in millimeters (mm) and the angle α in degrees (°), the constant B is in the range between 0.785 mm and 0.875 mm, the constant $\alpha_A$ is in the range between 8.25° and 17.25° and the constant C lies in a range from 12.3° mm to 12.6° mm.

We claim:

1. A spray nozzle for high-pressure cleaning apparatus comprising a nozzle body, said body having a longitudinal channel which ends in a downstream mouth, said channel defining a channel wall which narrows towards said mouth in a downstream direction, said channel wall and mouth defining an edge of a liquid passage having a fixed width b and a defined length, and said width b of the passage defined by the edge and an angle α between the channel wall at the edge and a longitudinal axis of the channel being in a range defined by the equation:

$$(b-B)\cdot(\alpha-\alpha_o)=C_1$$

in which: the width b is measured in millimeters (mm) and the angle α in degrees (°), the constant B is in a range between 0.785 mm and 0.875 mm, the constant $\alpha_O$ is in between 8.25°, and 17.25°, and the constant C is in range from 12° mm to 13° mm.

2. The spray nozzle of claim 1 in which the angle α between said wall of the channel and said longitudinal axis and said passage is the angle measured at a narrowest point.

3. The spray nozzle of claim 1 in which the constant B is in a range between 0.798 mm and 0.862 mm, the constant $\alpha_O$ is in a range between 9.55° and 15.95° and the constant C is 12.6° mm.

4. The spray nozzle of claim 1 in which the constant B is 0.83 mm and the constant $\alpha_O$ is 12.75°.

5. The spray nozzle of claim 1 in which said passage has an axial length in a range between 1.1 times and twice the width b of the passage.

6. The spray nozzle claim 1 in which the width b of the passage lies in a range from 0.95 to 2.45 mm.

7. The spray nozzle of claim 1 in which said angle α between said channel wall and the longitudinal axis of the channel is between 15° and 80°.

8. The spray nozzle of claim 1 in which said channel is formed rotationally symmetrical about said longitudinal axis up to said passage.

9. The spray nozzle of claim 1 in which said edge of said passage is continuously curved.

10. The spray nozzle of claim 1 in which said passage is defined by a groove which intersects said channel wall of said nozzle body transversely to said longitudinal axis.

11. The spray nozzle of claim 10 in which said groove has a base curved at opposite transverse ends.

12. The spray nozzle of claim 1 in which said channel wall is spherically domed.

13. The spray nozzle of claim 1 in which said channel wall has a smooth surface.

14. The spray nozzle of claim 1 in which said nozzle mouth at said passage is bounded by two substantially planar wall sections located in parallel spaced apart relation to each other.

15. The spray nozzle of claim 1 in which the channel is constructed free of offsets.

16. The spray nozzle of claim 1 in which said channel leading through the nozzle body is narrowed from a large diameter to a comparatively small diameter of an essentially cylindrical section.

17. The spray nozzle of claim 1 in which said passage generates a fan-shaped jet discharge with a spray angle of between 15° to 25°.

18. The spray nozzle of claim 1 in which said nozzle body is constructed in one piece.

* * * * *